US012239241B2

(12) United States Patent
Mountz et al.

(10) Patent No.: US 12,239,241 B2
(45) Date of Patent: Mar. 4, 2025

(54) INFANT HIGHCHAIR

(71) Applicant: Wonderland Switzerland AG, Steinhausen (CH)

(72) Inventors: Jonathan K. Mountz, Birdsboro, PA (US); Nathanael Saint, Morgantown, PA (US)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 18/494,124

(22) Filed: Oct. 25, 2023

(65) Prior Publication Data

US 2024/0108153 A1 Apr. 4, 2024

Related U.S. Application Data

(63) Continuation of application No. 17/397,633, filed on Aug. 9, 2021, now Pat. No. 11,819,141, which is a (Continued)

(51) Int. Cl.
*A47D 1/00* (2006.01)
*A47D 1/02* (2006.01)

(52) U.S. Cl.
CPC ..... *A47D 1/006* (2013.01); *A47D 1/004* (2013.01); *A47D 1/023* (2017.05)

(58) Field of Classification Search
CPC ..... A47D 1/006; A47D 1/04; A47D 1/023
See application file for complete search history.

(56) References Cited

U.S. PATENT DOCUMENTS 605,682 A 6/1898 Seibert
2,731,072 A 1/1956 Post
(Continued)

FOREIGN PATENT DOCUMENTS

CA 2491548 A1 7/2005
CN 103802694 A 5/2014
(Continued)

OTHER PUBLICATIONS

Chinese First Office Action; Chinese Application No. 201910618980.4; Date: Aug. 2, 2022; 23 pages (WIA0009CN).
(Continued)

*Primary Examiner* — Timothy J Brindley
(74) *Attorney, Agent, or Firm* — CANTOR COLBURN LLP

(57) ABSTRACT

An infant highchair includes a standing frame including a support platform, a seat pivotally connected with the standing frame and having a seating surface, and a locking mechanism operable to lock the seat in position. The seat is rotatable between a first and a second position, the first position allowing a child to sit in contact with the seating surface, and the second position being suitable to receive installation of a removable child seat over the seat while disabling seating of a child on the seating surface, the seating surface moving around the support platform when the seat rotates relative to the standing frame, the second position of the seat uncovering the support platform so that a removable child seat is installable over the seat at least partially supported in contact with the support platform. The locking mechanism is operable to lock the seat in the first and second position.

14 Claims, 10 Drawing Sheets

Related U.S. Application Data continuation of application No. 16/504,152, filed on Jul. 5, 2019, now Pat. No. 11,116,329.

(60) Provisional application No. 62/695,909, filed on Jul. 10, 2018.

(56) References Cited

U.S. PATENT DOCUMENTS

| | | | |
|---|---|---|---|
| 4,603,902 | A | 8/1986 | Maloney |
| 5,238,291 | A | 8/1993 | Alionis |
| 5,509,719 | A | 4/1996 | Cone, II |
| 6,082,814 | A | 7/2000 | Celestina-Krevh et al. |
| 6,938,952 | B2 | 9/2005 | Dauterive |
| 7,461,891 | B1 | 12/2008 | Andersen |
| 9,554,658 | B2 | 1/2017 | Horst et al. |
| 10,588,425 | B1 | 3/2020 | Jordan |
| 2006/0249994 | A1 | 11/2006 | Drake |
| 2010/0096891 | A1 | 4/2010 | Keegan |
| 2015/0359354 | A1 | 12/2015 | Greger |
| 2017/0251826 | A1 | 9/2017 | Sclare et al. |
| 2017/0258244 | A1 | 9/2017 | Waldman et al. |
| 2018/0263379 | A1* | 9/2018 | Cheng ..... A47D 1/103 |

FOREIGN PATENT DOCUMENTS

| | | | |
|---|---|---|---|
| CN | 105857381 | A | 8/2016 |
| CN | 107364483 | A | 11/2017 |
| CN | 207285732 | U | 5/2018 |
| GB | 191303024 | | 11/1913 |
| GB | 605682 | A | 7/1948 |
| GB | 2526936 | B | 7/2016 |

OTHER PUBLICATIONS

GB Search Report; GB Application No. 2212758.3; Date: Sep. 13, 2022; 4 pages (WIA0009GBD4).

* cited by examiner

100A

100A

100A

100A

100B

INFANT HIGHCHAIR

CROSS-REFERENCE TO RELATED APPLICATIONS

This application is a continuation application of U.S. application Ser. No. 17/397,633 filed Aug. 9, 2021, which is a continuation application of U.S. patent application Ser. No. 16/504,152 filed on Jul. 5, 2019, now Issued U.S. Pat. No. 11,116,329, issued on Sep. 14, 2021, which claims the benefit of U.S. provisional application No. 62/695,909 filed on Jul. 10, 2018, the disclosures of both of which are hereby incorporated by reference as if set forth in their entireties herein.

BACKGROUND

1. Field of the Invention

The present invention relates to infant highchairs.

2. Description of the Related Art

Some infant highchairs currently available on the market may have a seat and a tray that are removable from the highchair frame for use as a standalone infant booster seat. When the booster seat is removed from the highchair frame, there is no longer a usable seating surface on the highchair frame, which becomes useless.

Therefore, there is a need for an improved highchair for infants that can be more flexible in use and address at least the foregoing issues.

SUMMARY

The present application describes an infant highchair having a seat rotatable to convert the infant highchair to multiple configurations of use. According to one aspect, the infant highchair includes a standing frame including a support platform, a seat pivotally connected with the standing frame and having a seating surface, and a locking mechanism operable to lock the seat in position. The seat is rotatable between a first and a second position, the first position allowing a child to sit in contact with the seating surface, and the second position being suitable to receive installation of a removable child seat over the seat while disabling seating of a child on the seating surface, the seating surface moving around the support platform when the seat rotates relative to the standing frame, the second position of the seat uncovering the support platform so that a removable child seat is installable over the seat at least partially supported in contact with the support platform. The locking mechanism is operable to lock the seat in the first and second position.

DETAILED DESCRIPTION OF THE EMBODIMENTS

Figure 1:
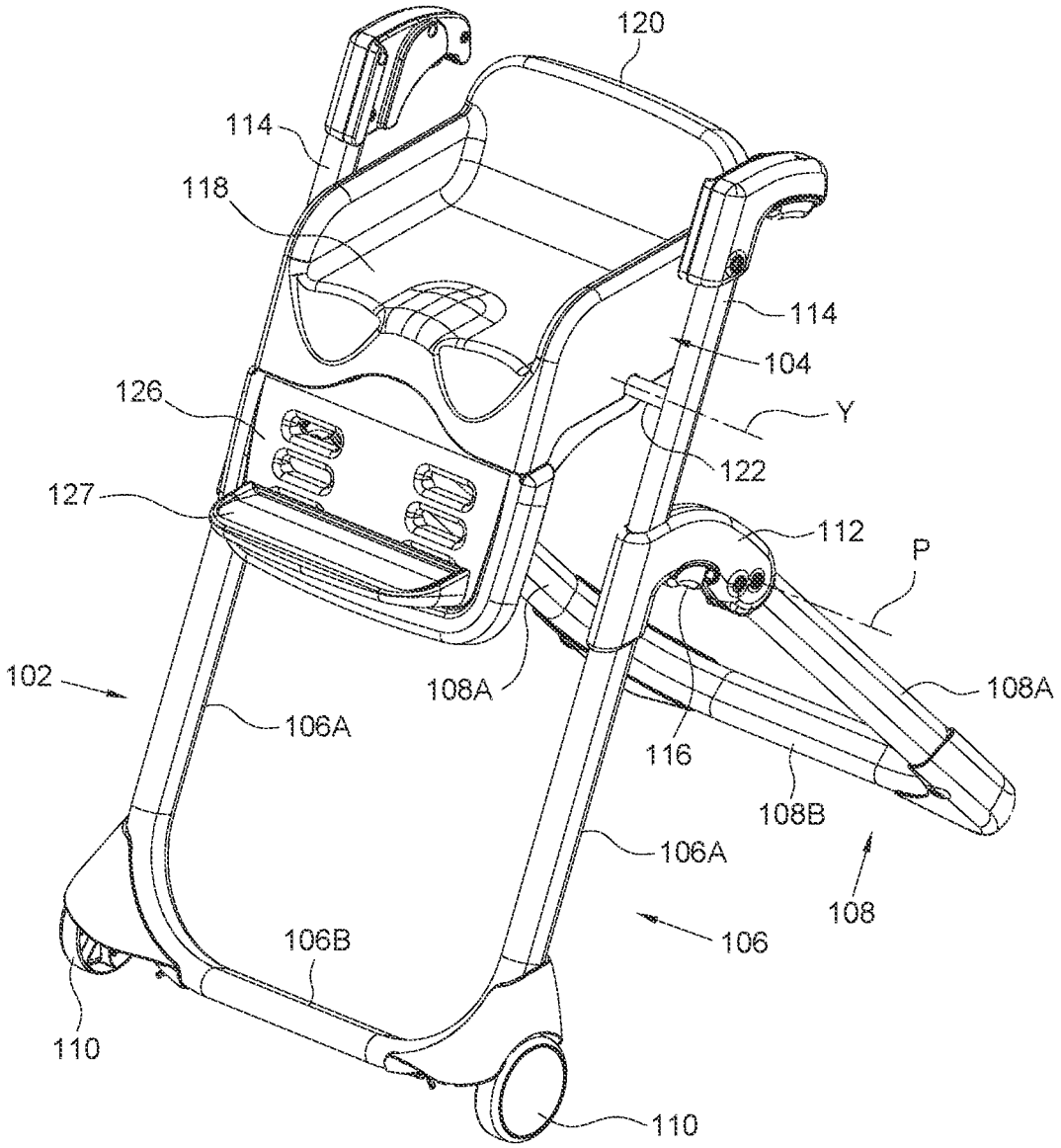
FIG. 1 is a perspective view illustrating an embodiment of an infant high chair.
Figure 2:
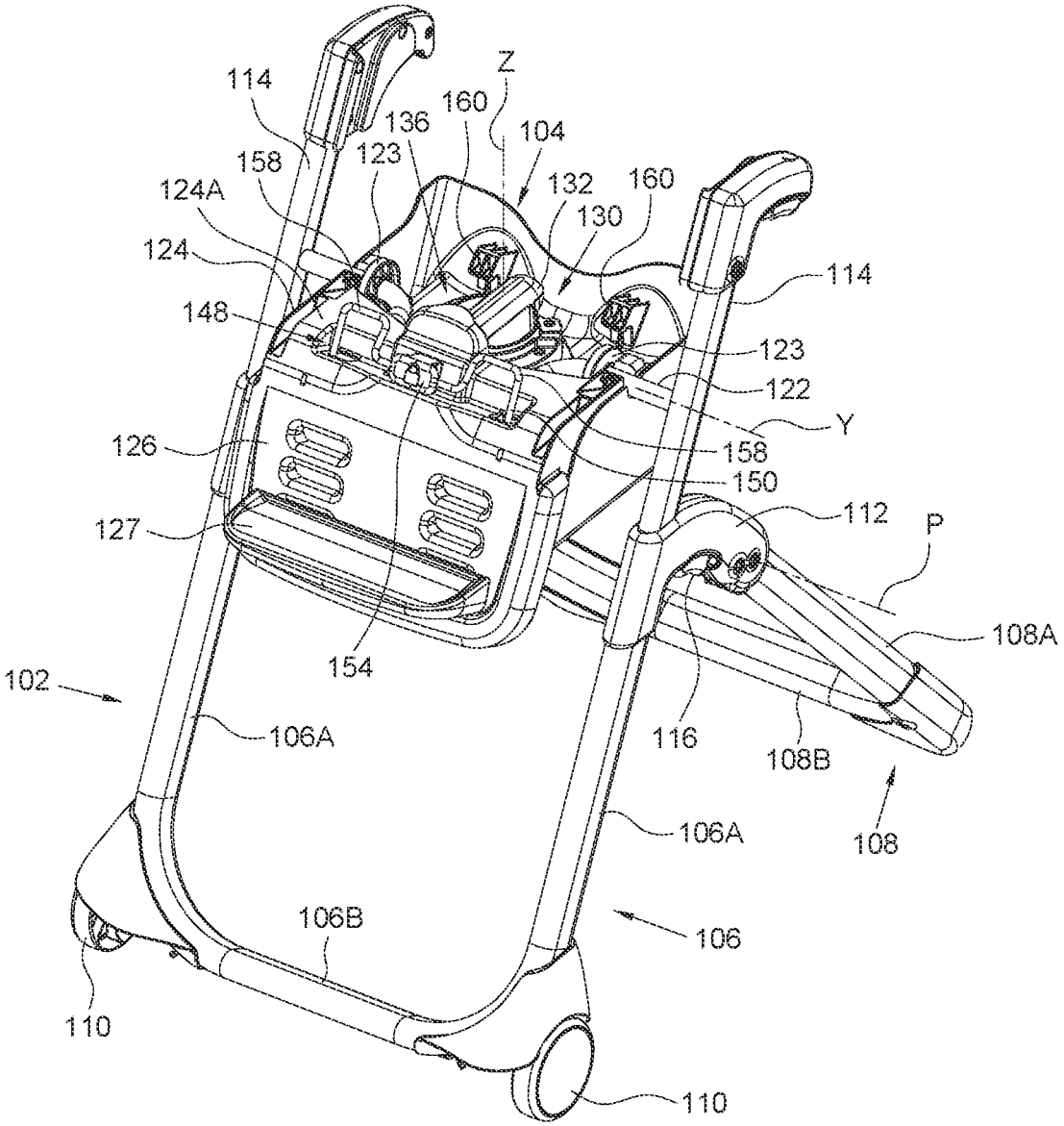
FIG. 2 is a perspective view illustrating the infant highchair of FIG. 1 in a different configuration.
Figure 3:
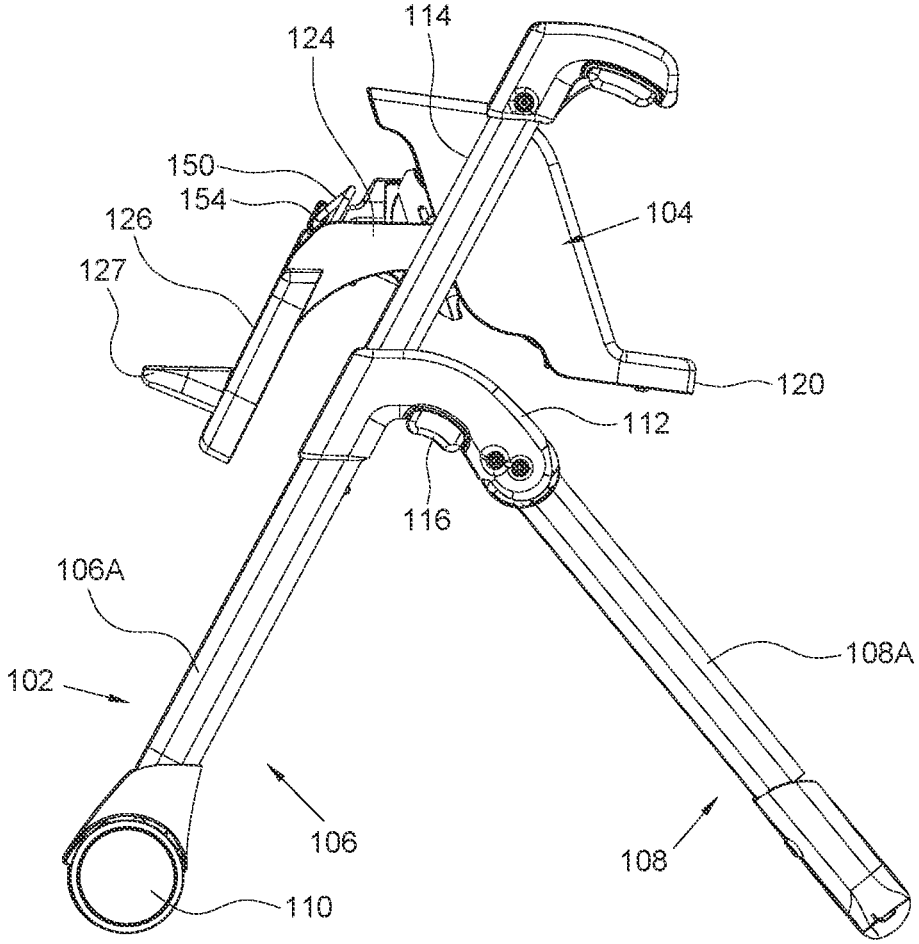
FIG. 3 is a side view illustrating exemplary adjustment of the infant highchair between the two configurations shown in FIGS. 1 and 2.

FIGS. 1 and 2 are perspective views illustrating an embodiment of an infant highchair 100A in two different configurations, and FIG. 3 is a side view illustrating exemplary adjustment of the infant highchair 100A between the two configurations shown in FIGS. 1 and 2. Referring to FIGS. 1-3, the infant highchair 100A can include a standing frame 102 and a seat 104 assembled with each other.

The standing frame 102 can include a front leg portion 106 and a rear leg portion 108. The front leg portion 106 can have two leg segments 106A, and a transversal segment 106B connected between the two leg segments 106A near the lower ends thereof. Likewise, the rear leg portion 108 can have two leg segments 108A, and a transversal segment 108B connected between the two leg segments 108A near the lower ends thereof. Moreover, a plurality of wheels 110 can be respectively provided on at least the front leg portion 106 to facilitate transport of the infant highchair 100A.

The front leg portion 106 can be pivotally connected with the rear leg portion 108 about a pivot axis P. For example, two coupling parts 112 can respectively connect pivotally the two leg segments 106A of the front leg portion 106 with the two leg segments 108A of the rear leg portion 108 about the pivot axis P. The two coupling parts 112 can be similar in construction and can be arranged at a left and right side of the standing frame 102. For example, each coupling part 112 can be slidably connected with one corresponding leg segment 106A of the front leg portion 106, and pivotally connected with one corresponding leg segment 108A of the rear leg portion 108. The coupling parts 112 can respectively slide along the leg segments 106A of the front leg portion 106 to adjust a height of the infant highchair 100A. Each leg segment 106A of the front leg portion 106 can respectively extend outside the corresponding coupling part 112 at two opposite sides thereof so that each leg segment 106A can have an upper portion 114 located above the coupling part 112 when the infant highchair 100A stands on a floor surface.

According to an example of construction, each coupling part 112 can include a latch (not shown) operable to lock the standing frame 102 in an unfolded state for use and unlock the standing frame 102 for folding of the infant highchair 100A. A release actuator 116 exposed outward for operation may be connected with the latch of the coupling part 112 via a cable (not shown), whereby the release actuator 116 is operable to cause the latch to unlock for rotation of the front leg portion 106 relative to the rear leg portion 108.

Referring to FIGS. 1 and 2, the seat 104 can have a seating surface 118 and a backrest portion 120, and is suitable to receive a child sitting in contact with the seating surface 118 with the child's back supported by the backrest portion 120. According to an example of construction, the seat 104 including the seating surface 118 and the backrest portion 120 may be formed integrally as a unitary part. The seat 104 is pivotally connected with the standing frame 102 about a pivot axis Y. For example, the upper portions 114 of the leg segments 106A can be respectively connected fixedly with a bar segment 122 extending transversally from a left to a right side of the standing frame 102, and the seat 104 can be pivotally connected with the bar segment 122 for rotation about the pivot axis Y. The pivot connection of the seat 104 can exemplarily include assembling the bar segment 122 through two pivot brackets 123 that are fixedly connected with the seat 104. The seat 104 is thereby rotatable relative to the standing frame 102 between multiple positions corresponding to different configurations of use. For example, the seat 104 may be rotated to a first position where the seating surface 118 faces upward, which allows a child to sit on the seat 104 in contact with the seating surface 118. The first position of the seat 104 is shown in FIG. 1, and can correspond to a first configuration of use in which a child can directly sit on the seat 104 integrated with the infant highchair 100A.

Figure 4:
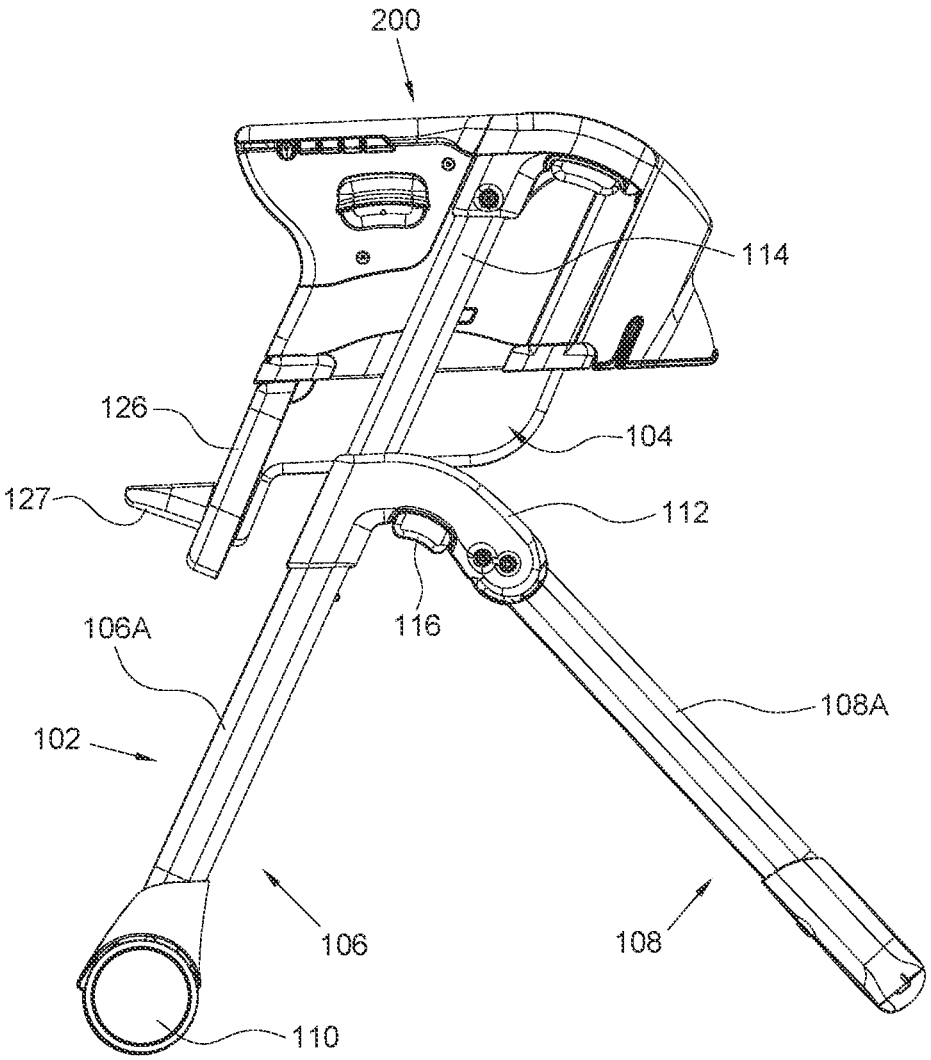
FIG. 4 is a side view illustrating the infant highchair of FIG. 1 with a removable child seat installed over a seat of the infant highchair.

Moreover, the seat 104 may be rotated to a second position where the seating surface 118 faces downward, which is suitable to receive the installation of a removable child seat over the seat 104 while disabling seating of a child on the seating surface 118. The second position of the seat 104 is shown in FIG. 2, and can correspond to a second configuration of use in which a removable child seat can be installed on the infant highchair 100A for seating a child thereon. FIG. 3 is a side view illustrating the seat 104 rotated to an intermediate angular position between the first and second position, and FIG. 4 is a side view illustrating a removable child seat 200 installed over the seat 104 in the second position. Examples of removable child seats installable on the infant highchair 100A in the second configuration of use can include, without limitation, booster seats.

As better shown in FIG. 2, the standing frame 102 may include a support platform 124 configured to receive the mount of a removable child seat when the seat 104 is in the second position. The support platform 124 may be assembled with the leg segments 106A in a region between the upper portions 114 of the leg segments 106A. For example, the support platform 124 may be fixedly attached to the bar segment 122.

The seating surface 118 of the seat 104 can move around the support platform 124 when the seat 104 rotates relative to the standing frame 102. For example, the seating surface 118 can be located above the support platform 124 when the seat 104 is in the first position and below the support platform 124 when the seat 104 is in the second position. When the seat 104 is in the first position, the support platform 124 is upwardly covered by the seat 104, which disables mounting of a removable child seat on the support platform 124. When the seat 104 is in the second position, the seat 104 can uncover the support platform 124, which allows a removable child seat to be installed over the seat 104 at least partially supported by and in contact with the support platform 124. For example, the support platform 124 can have an upper surface 124A configured to restrictedly position and support the removable child seat. Structures that may be provided on the upper surface 124A of the support platform 124 for engagement of a removable child seat may include, without limitation, recesses, protrusions and the like.

According to an example of construction, the standing frame 102 can further include a calf support portion 126 fixedly connected with the support platform 124. The calf support portion 126 may be formed integrally with the support platform 124 as a unitary part, or may be fixedly attached to the support platform 124 via a fastener. During use, the seat 104 can rotate relative to the standing frame 102 and the calf support portion 126 between the first and second position, and the calf support portion 126 is adapted to provide support for the calves of a child in both the first and second configurations of use corresponding to the first and second positions of the seat 104. For example, the calf support portion 126 can extend downward from a front of the seating surface 118 of the seat 104 when the seat 104 is in the first position (as better shown in FIG. 1), and can extend downward from a front of a removable child seat 200 installed on the support platform 124 when the seat 104 is in the second position (as better shown in FIG. 4). The backrest portion 120 of the seat 104 may be disposed adjacent to the calf support portion 126 when the seat 104 is in the second position. In addition, the calf support portion 126 may include a footrest 127 adapted to support the feet of a child. According to an example of construction, the position of the footrest 127 on the calf support portion 126 may be adjustable according to the length of the child's legs.

Figure 5:
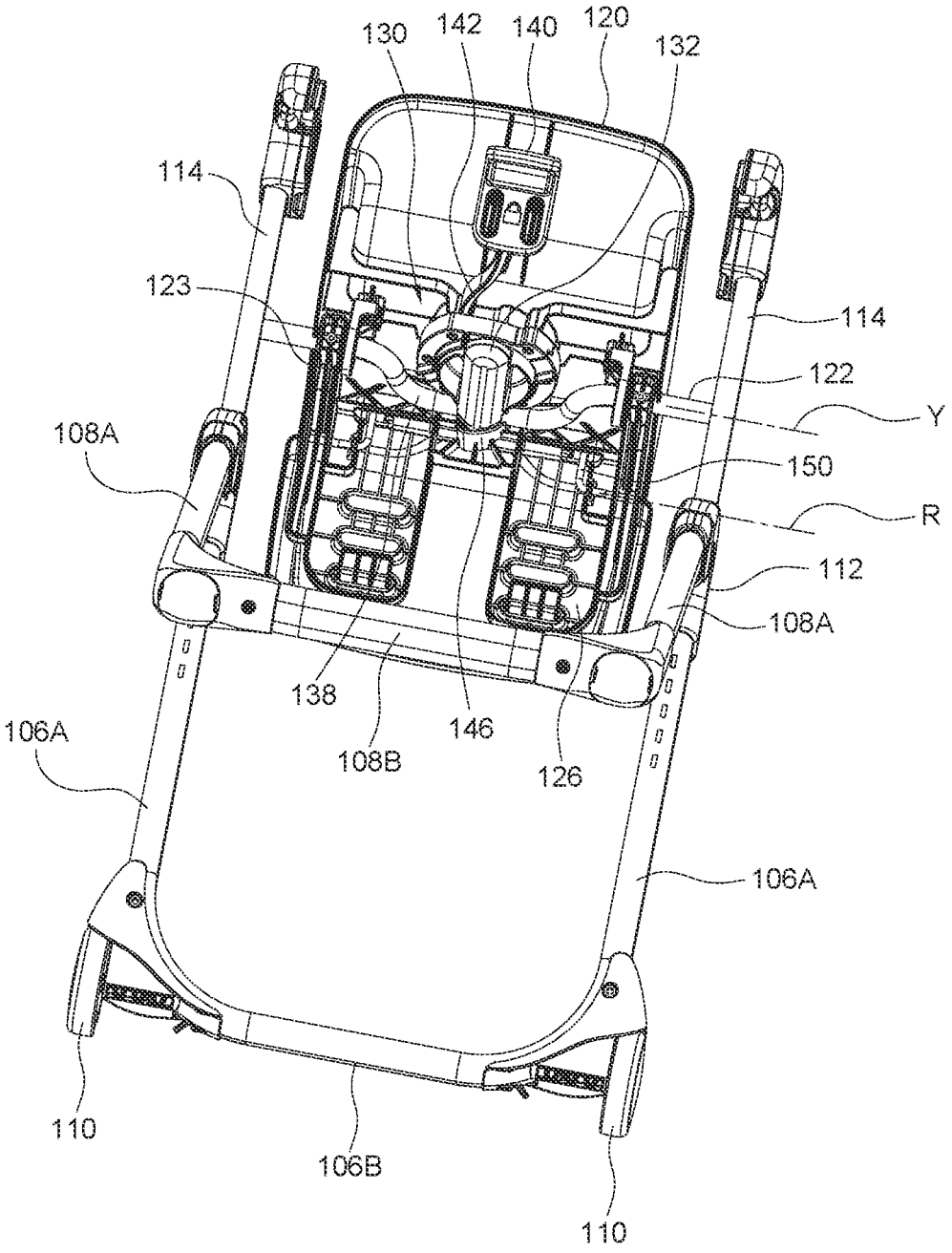
FIG. 5 is a perspective view illustrating further construction details of the infant highchair.
Figure 6:
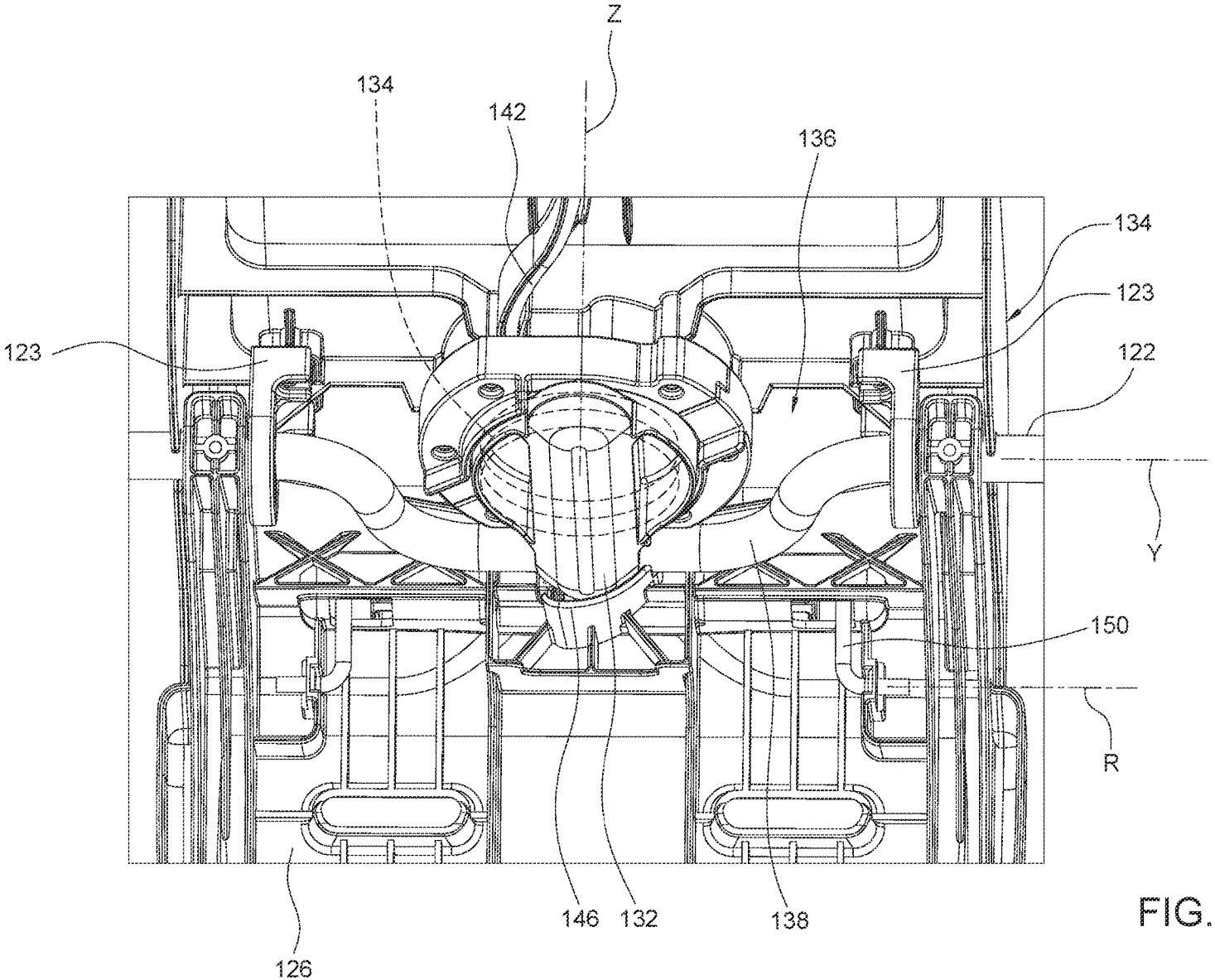
FIG. 6 is an enlarged view illustrating a locking mechanism provided in the infant highchair.

In conjunction with FIGS. 1-4, FIG. 5 is a perspective view illustrating further construction details of the infant highchair 100A, and FIG. 6 is an enlarged view illustrating a locking mechanism 130 provided in the infant highchair 100A. Referring to FIGS. 1-6, the infant highchair 100A further includes a locking mechanism 130 operable to lock the seat 104 in the first and second position. The locking mechanism 130 can include a latch 132 and a spring 134 (shown with phantom lines in FIG. 6).

According to an example of construction, the latch 132 can be assembled with the seat 104. For example, the latch 132 can be disposed centrally in a cavity 136 of the seat 104, and can be pivotally connected with the seat 104 about a pivot axis Z. The pivot axis Z can extend substantially vertically when the infant highchair 100A stands on a floor surface and the seat 104 is in any of the first and second positions. The latch 132 can engage with the standing frame 102 to lock the seat 104 in the first and second position, and disengage from the standing frame 102 to unlock the seat 104 for rotation of the seat 104 between the first and second position. For example, the latch 132 can engage with and disengage from the bar segment 122 for locking and unlocking the seat 104. More specifically, the latch 132 may engage with a first side of the bar segment 122 of the standing frame 102 to lock the seat 104 in the first position, and may engage with a second side of the bar segment 122 opposite to the first side to lock the seat 104 in the second position. According to an example of construction, the bar segment 122 may have a bending portion 138 at a central location of the bar segment 122 that protrudes away from the pivot axis Y of the seat 104, and the latch 132 is rotatable relative to the seat 104 generally parallel to the bar segment 122 between a locking state engaged with the bending portion 138 for locking the seat 104 in the first or second position, and an unlocking state disengaged from the bending portion 138 for unlocking the seat 104. When the latch 132 is engaged with the bar segment 122, the bending portion 138 of the bar segment 122 may be restrictedly held between the latch 132 at one side and the seat 104 at an opposite side.

Referring to FIG. 6, the spring 134 can be respectively connected with the latch 132 and the seat 104. According to an example of construction, the spring 134 may be a torsion spring disposed around the pivot axis Z of the latch 132. The spring 134 can apply a biasing action that urges the latch 132 toward the locking state for locking engagement with the bar segment 122 of the standing frame 102.

According to an example of construction, the latch 132 may be exposed so that a caregiver can directly operate the latch 132 with a hand for unlocking the seat 104. According to another example of construction, the locking mechanism 130 may further include a release actuator 140 (better shown in FIG. 5) that is remotely connected with the latch 132 and is operable to cause the latch 132 to unlock the seat 104. For example, the release actuator 140 may be slidably disposed on the backrest portion 120 of the seat 104, and may be connected with the latch 132 via a cable 142. The release actuator 140 is operable to pull on the cable 142, which in turn urges the latch 132 to rotate from the locking state to the unlocking state for disengaging from the bar segment 122 of the standing frame 102.

Figure 7:
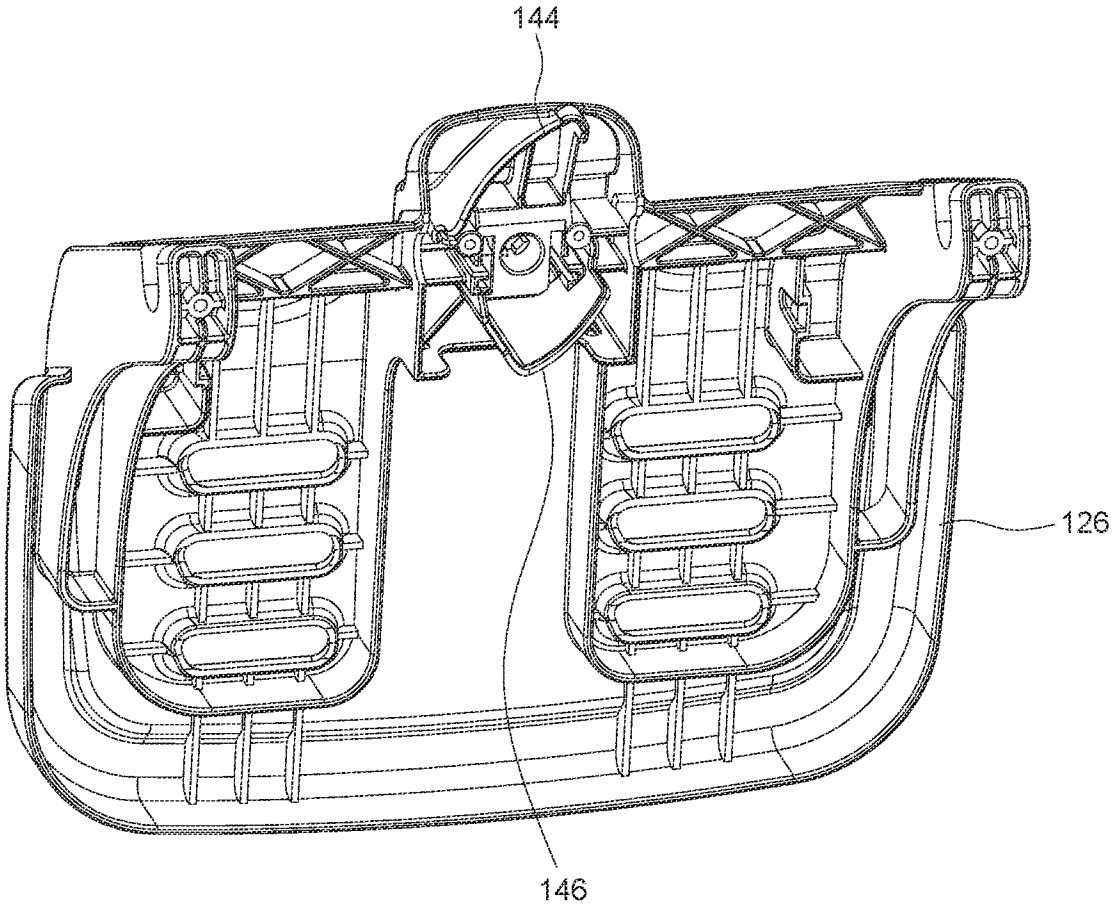
FIG. 7 is a perspective view illustrating a calf support portion provided in the infant highchair.

In case a caregiver releases the release actuator 140 or the latch 132 during adjustment of the seat 104 between the first and second position, the latch 132 may recover a position corresponding to the locking state owing to the biasing action of the spring 134. Referring to FIGS. 5-7, the standing frame 102 may include two cam surfaces 144 and 146 configured to displace the latch 132 for facilitating self-locking of the seat 104 in the first and second position. The cam surfaces 144 and 146 can be fixedly connected with the support platform 124 (e.g., adjacent to the calf support portion 126) at two opposite sides of the bending portion 138, and can respectively face the latch 132. According to an example of construction, each of the cam surfaces 144 and 146 can respectively be shaped as a portion of a spiral.

The cam surface 144 may be disposed above the bending portion 138 of the bar segment 122, and may be able to contact and push the latch 132 in movement against the biasing action of the spring 134 as the seat 104 approaches the first position for facilitating continued rotation of the seat 104 to the first position. Once the seat 104 reaches the first position, the latch 132 can disengage from the cam surface 144 and can be urged by the spring 134 to engage with the bending portion 138 of the bar segment 122 for locking the seat 104 in position.

The cam surface 146 may be disposed below the bending portion 138 of the bar segment 122, and may be able to contact and push the latch 132 in movement against the biasing action of the spring 134 as the seat 104 approaches the second position for facilitating continued rotation of the seat 104 to the second position. Once the seat 104 reaches the second position, the latch 132 can disengage from the cam surface 146 and can be urged by the spring 134 to engage with the bending portion 138 of the bar segment 122 for locking the seat 104 in position.

Figure 8:
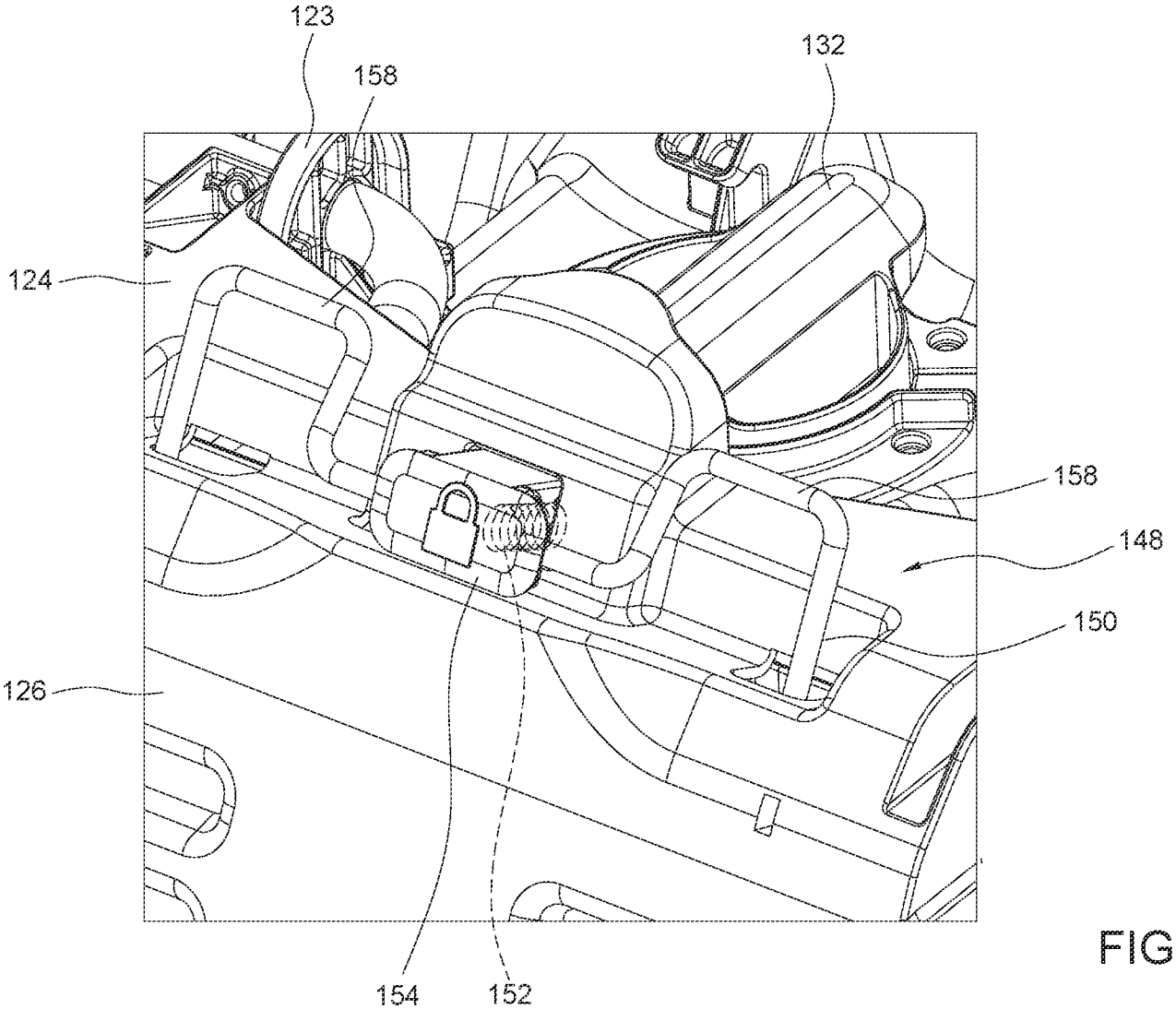
FIG. 8 is an enlarged view illustrating a portion of a safety mechanism provided in the infant highchair.

Referring to FIGS. 2, 3, 5 and 6, the infant highchair 100A can further include a safety mechanism 148 configured to prevent accidental rotation of the seat 104 from the first position to the second position. FIG. 8 is an enlarged view illustrating a portion of the safety mechanism 148. Referring to FIGS. 2, 3, 5, 6 and 8, according to an example of construction, the safety mechanism 148 can include an impeding part 150, a spring 152 (shown with phantom lines in FIG. 8) and a release actuator 154. The impeding part 150 may be movably assembled with the standing frame 102. For example, the impeding part 150 may be pivotally connected with the standing frame 102, e.g., with the support platform 124 or the calf support portion 126 of the standing frame 102. According to an example of construction, the impeding part 150 can include a rod extending generally transversally along a width direction of the seat 104 that has two opposite ends pivotally connected with the calf support portion 126 of the standing frame 102. The impeding part 150 can thereby rotate about a pivot axis R that extends transversally from a left side to a right side of the seat 104 between a hindering position and a release position. According to an example of construction, the impeding part 150 may be disposed adjacent to the calf support portion 126.

The impeding part 150 is configured to engage with the seat 104 for forcing the seat 104 to stop at an intermediate position during a rotation of the seat 104 from the first position toward the second position while allowing continuous rotation of the seat 104 from the second position past the intermediate position to the first position. For example, the impeding part 150 may have two bending portions 158 that protrude upward above the bar segment 122 and the support platform 124 and are radially offset from the pivot axis R of the impeding part 150, and the seat 104 can have two hooks 160 (better shown in FIG. 2) that are movable along with the seat 104 and can respectively engage with and disengage from the two bending portions 158. During rotation of the seat 104 from the first position toward the second position, the hindering position of the impeding part 150 can force the seat 104 to stop at an intermediate position between the first and second position owing to the engagement between the hooks 160 and the bending portions 158. This intermediate position can be exemplary at an angle of about 15 degrees from the first position. During rotation of the seat 104 from the second position toward the first position, the hooks 160 can respectively contact and push against the bending portions 158 so that the impeding part 150 is forced by the seat 104 to rotate from the hindering position to the release position to allow continuous travel of the seat 104 past the intermediate position to the first position.

The spring 152 is shown with phantom lines in the enlarged view of FIG. 8. Referring to FIGS. 2 and 8, the spring 152 can be configured to bias the impeding part 150 toward the hindering position. According to an example of construction, the spring 152 may be a compression spring respectively connected with the standing frame 102 (e.g., the support platform 124 or the calf support portion 126 of the standing frame 102) and the impeding part 150. More specifically, the spring 152 may be exemplarily disposed adjacent to the release actuator 154.

The release actuator 154 can be connected with the impeding part 150. For example, the release actuator 154 may be fixedly connected with the impeding part 150 at a middle location between the two bending portions 158. The release actuator 154 is operable to cause the impeding part 150 to rotate from the hindering position to the release position against the biasing force of the spring 152, which can disengage the bending portions 158 of the impeding part 150 from the hooks 160 of the seat 104.

Exemplary operation of the safety mechanism 148 is described hereinafter with reference to FIGS. 1-8. When the seat 104 is to be adjusted from the first position to the second position, the release actuator 140 can be operated so as to cause the latch 132 to unlock the seat 104. Then the unlocked seat 104 can be rotated from the first position toward the second position. As the seat 104 rotates toward the second position and reaches the intermediate position, the hooks 160 of the seat 104 can come into engagement with the impeding part 150 that is kept in the hindering position owing to the biasing force of the spring 152. As a result, the seat 104 is forced to stop at the intermediate position. The release actuator 154 may be concealed when the seat 104 is in the first position, and become exposed for operation at a front of the seat 104 when the seat 104 is in the intermediate position. For further rotating the seat 104 from the intermediate position to the second position, a caregiver has to operate the release actuator 154 to cause the impeding part 150 to rotate from the hindering position to the release position and disengage from the seat 104. Once the seat 104 is released from the hold of the impeding part 150, the seat 104 can be rotated from the intermediate position to the second position. By requiring a caregiver's manual operation for disengaging the impeding part 150 from the seat 104, the safety mechanism 148 can prevent accidental rotation of the seat 104 to the second position.

When the seat 104 is to be adjusted from the second position to the first position, the release actuator 140 can be operated to unlock the seat 104 like described previously. Then the unlocked seat 104 can be rotated from the second position toward the first position. As the seat 104 rotates toward the second position and approaches the intermediate position, the hooks 160 of the seat 104 can have respective ramp surfaces 160A that contact and push against the bending portions 158 of the impeding part 150 so that the impeding part 150 is urged to rotate from the hindering position to the release position against the biasing force of the spring 152. Accordingly, the safety mechanism 148 allows continuous rotation of the seat 104 from the second position past the intermediate position to the first position without the need of operating the release actuator 154.

Figure 9:
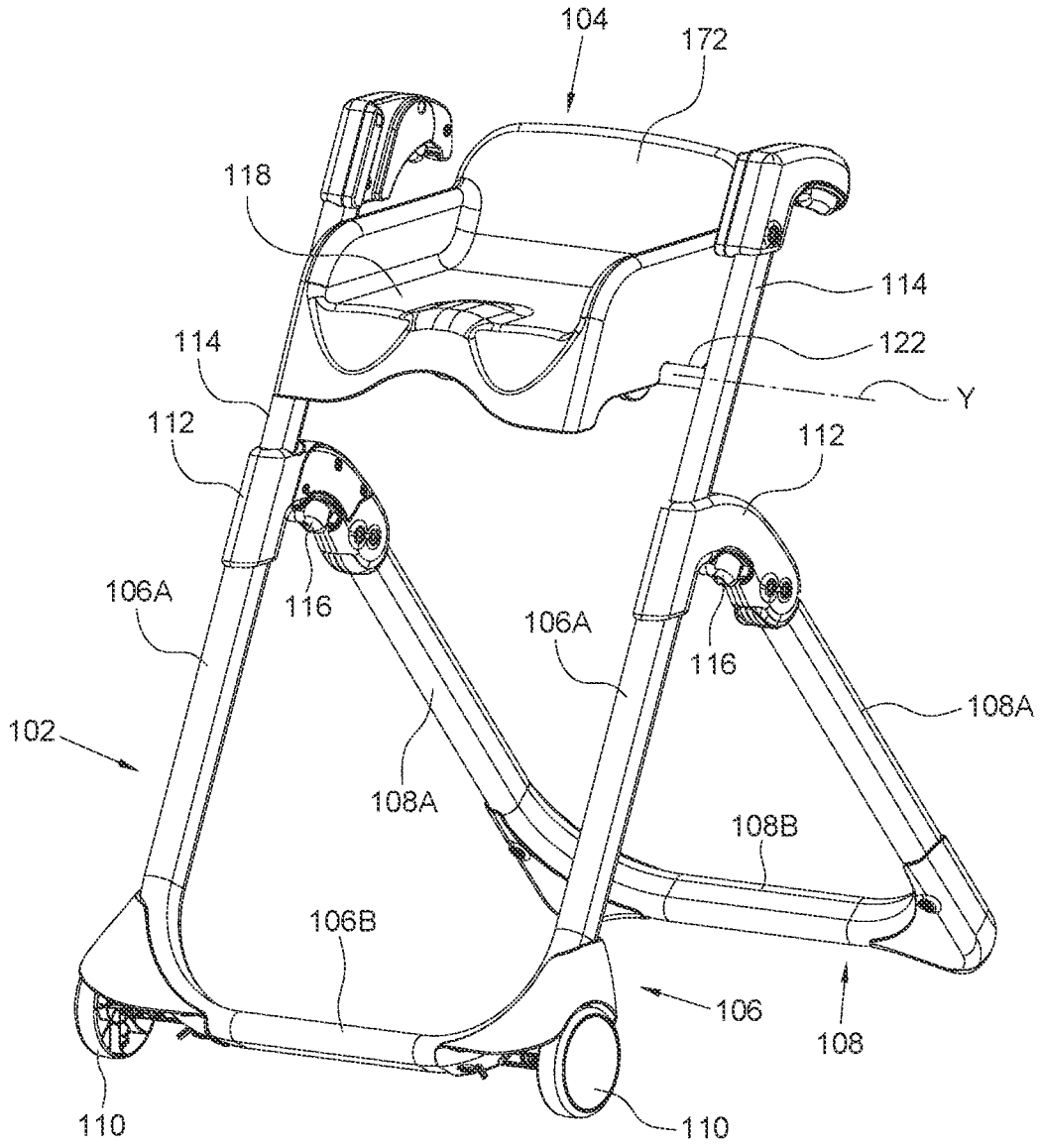
FIG. 9 is a perspective view illustrating another embodiment of an infant highchair.
Figure 10:
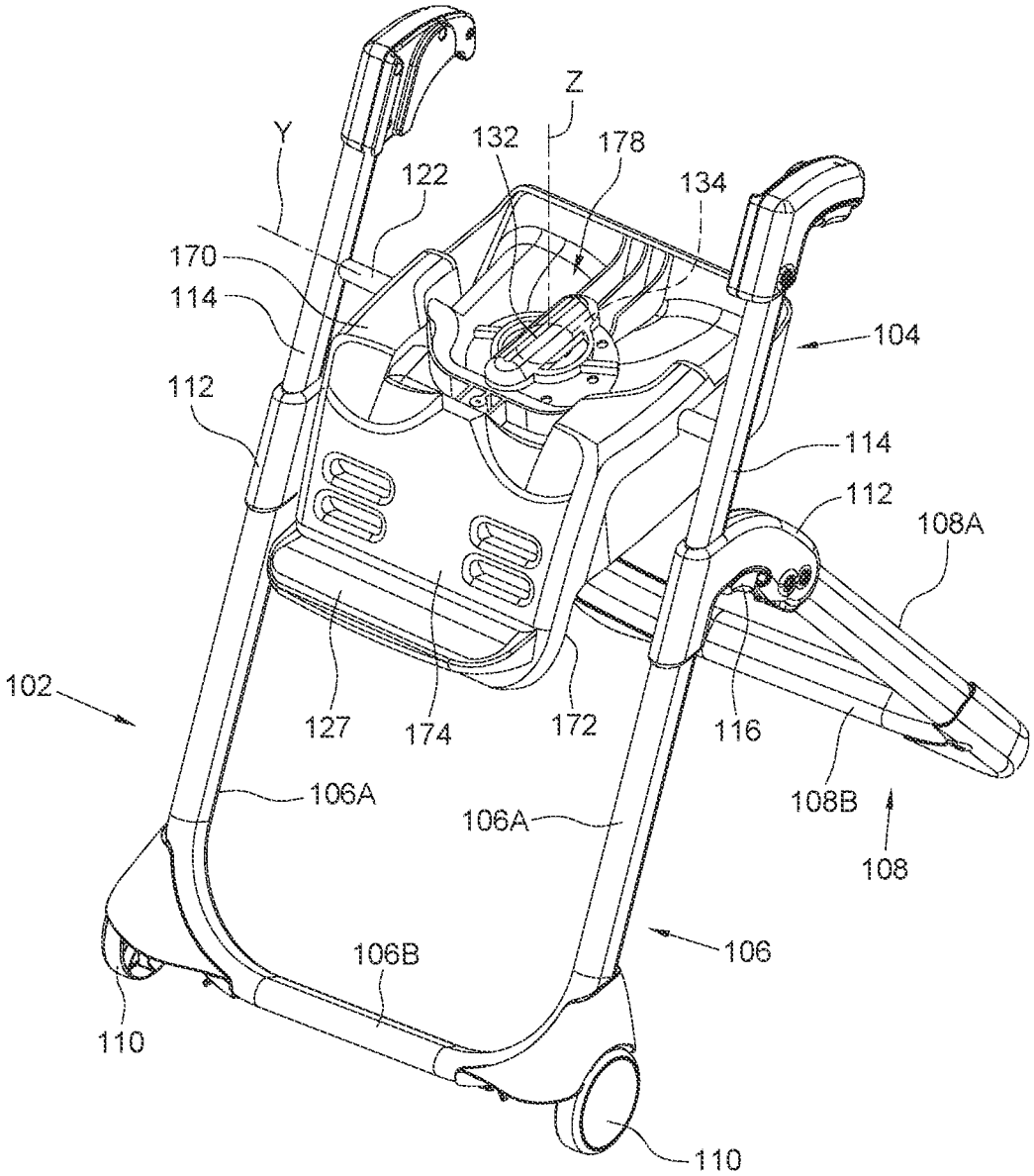
FIG. 10 is a perspective view illustrating the infant highchair of FIG. 9 in a different configuration.

FIGS. 9 and 10 are perspective views illustrating another embodiment of an infant highchair 100B. Referring to FIGS. 9 and 10, the infant highchair 100B may have the same standing frame 102 like described previously. Compared to the infant highchair 100A of the previous embodiment, the infant highchair 100B has a different construction of the seat 104 and does not include the support platform 124. More specifically, the seat 104 of the infant highchair 100B can have the seating surface 118 for receiving direct sitting of a child, and can further include a mount surface 170 suitable to receive the installation of a removable child seat. The seating surface 118 and the mount surface 170 can be located at two opposite sides of the seat 104. Moreover, the seat 104 can further include a protruding portion on which a backrest portion 172 and a calf support portion 174 are provided. The backrest portion 172 and the calf support portion 174 can be disposed adjacent to each other and face two opposite directions. Moreover, the calf support portion 174 may have the footrest 127. The seat 104 including the seating surface 118, the mount surface 170, the backrest portion 172 and the calf support portion 174 may be provided as a unitary part. Accordingly, the seating surface 118, the mount surface 170, the backrest portion 172 and the calf support portion 174 can move in unison when the seat 104 rotates relative to the standing frame 102.

Like described previously, the seat 104 can be pivotally connected with the standing frame 102 about the bar segment 122, which can extend between the seating surface 118 and the mount surface 170 of the seat 104. The seat 104 of the infant highchair 100B is thereby rotatable between multiple positions corresponding to different configurations of use. For example, the seat 104 can be rotated to a first position (shown in FIG. 9) corresponding to a first configuration of use where a child can sit on the seat 104 in contact with the seating surface 118, and a second position (shown in FIG. 10) corresponding to a second configuration of use where a removable child seat can be installed on the seat 104 in contact with the mount surface 170 thereof.

Referring to FIGS. 9 and 10, the infant highchair 100B can further include a locking mechanism 178 operable to lock the seat 104 in the first and second position. The locking mechanism 178 can include the same latch 132 and spring 134 (shown with phantom lines in FIG. 10) provided in the infant highchair 100A. Like previously described, the latch 132 may be pivotally connected with the seat 104 about the pivot axis Z, and can rotate to engage and disengage two opposite sides of the bar segment 122 for locking or unlocking the seat 104 in the first and second positions. The spring 134 can be exemplary a torsion spring disposed around the pivot axis Z of the latch 132, and can be respectively connected with the latch 132 and the seat 104. The spring 134 can apply a biasing action that urges the latch 132 toward a locking state for locking engagement with the bar segment 122 of the standing frame 102.

According to an example of construction, the latch 132 may be exposed so that a caregiver can directly operate the latch 132 with a hand for unlocking the seat 104. According to another example of construction, the latch 132 may be connected with a release actuator (not shown) that is operable to cause the latch 132 to unlock the seat 104.

Exemplary operation of the infant highchair 100B will be described hereinafter with reference to FIGS. 9 and 10. When the seat 104 is in the first position shown in FIG. 9, the seating surface 118 can face upward and the backrest portion 172 can face forward and extend above the seating surface 118, which allows a child to sit on the seat 104 in contact with the seating surface 118 with the child's back resting against the backrest portion 172. The seat 104 can be locked in the first position by the engagement of the latch 132 with a first side of the bar segment 122 like described previously. The first position of the seat 104 can correspond to a first configuration of use in which a child can directly sit on the seat 104 integrated with the infant highchair 100B. In the first position, the mount surface 170 can face downward, which disables the use of the mount surface 170 for installing a removable child seat. Moreover, the calf support portion 174 can be positioned at a rear when the seat 104 is in the first position, which disables the use of the calf support portion 174 for supporting the calves of a child sitting on the seating surface 118.

For installing a removable child seat on the infant highchair 100B, the latch 132 can be operated to disengage from the bar segment 122 and thereby unlock the seat 104, and the seat 104 then can be rotated about the pivot axis Y to the second position shown in FIG. 10. When the seat 104 is in the second position, the seating surface 118 can face downward and the mount surface 170 can face upward, which is suitable to receive installation of a removable child seat on the seat 104 in contact with the mount surface 170 while disabling seating of a child on the seating surface 118. The seat 104 can be locked in the second position by the engagement of the latch 132 with a second side of the bar segment 122 opposite to the first side. The second position of the seat 104 can correspond to a second configuration of use in which a removable child seat can be installed on the infant highchair 100B for seating a child, the removable child seat being engaged with and supported by the seat 104. In the second position, the calf support portion 174 can extend downward from a front of the mount surface 170, which can provide support for the calves of a child who sits on the removable child seat installed on the mount surface 170.

Advantages of the structures described herein include the ability to provide an infant highchair that has a seat rotatable between multiple positions corresponding to different configurations of use. The seat may be adjusted to a first position corresponding to a configuration of use where a child can directly sit on the seat, and a second position corresponding to another configuration of use where a removable child seat can be installed over the seat for seating a child on the removable child seat. Accordingly, the infant highchair described herein can provide a more flexible use and may be adapted to receive children of different ages.

Realizations of the infant highchair have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant highchair comprising:

a standing frame;

a seat pivotally connected with the standing frame and having a seating surface and at least one hook, the seat being rotatable relative to the standing frame between a first position and a second position, the first position allowing a child to sit in contact with the seating surface, and the second position being suitable to receive installation of a removable child seat over the seat while disabling seating of a child on the seating surface; and a safety mechanism coupled to the standing frame, the safety mechanism being operable to restrict rotation of the seat from the first position to the second position at an intermediate position between the first position and the second position and to allow continuous rotation of the seat from the second position to the first position.

2. The infant highchair of claim 1, wherein the safety mechanism is movable between a hindering position and a release position, wherein in the hindering position, the safety mechanism is engageable with the at least one hook to restrict the rotation of the seat from the first position to the second position.

3. The infant highchair of claim 2, wherein the safety mechanism is engageable with the at least one hook when the seat is in an intermediate position, the intermediate position being between the first position and the second position.

4. The infant highchair of claim 3, wherein the intermediate position is at an angle of about 15 degrees relative to the first position.

5. The infant highchair of claim 3, wherein the standing frame further comprises a support platform, the seating surface being movable about the support platform as the seat rotates relative to the standing frame and the safety mechanism further comprises an impeding part having at least one bending portion, the impeding part being movable between the hindering position and the release position, wherein in the hindering position, the at least one bending portion protrudes above the support platform.

6. The infant highchair of claim 5, wherein the impeding part is pivotally coupled to a calf support portion of the standing frame.

7. The infant highchair of claim 5, wherein the at least one hook is engageable with the at least one bending portion when the impeding part is in the hindering position.

8. The infant highchair of claim 5, wherein the safety mechanism further comprises a spring operable to bias the impeding part toward the hindering position.

9. The infant highchair of claim 8, wherein when the seat rotates from the second position to the first position, the at least one hook is engageable with the impeding part to move the impeding part to the release position.

10. The infant highchair of claim 9, wherein when the seat rotates from the second position to the first position, the at least one hook is engageable with the impeding part to oppose the bias of the spring.

11. The infant highchair of claim 10, wherein the at least one hook includes a ramp surface operable to contact the at least one bending portion when the seat rotates from the second position to the first position.

12. The infant highchair of claim 5, further comprising a release actuator operably coupled to the impeding part, the release actuator being operable to transform the impeding part from the hindering position to the release position.

13. The infant highchair of claim 12, wherein the release actuator is concealed when the seat is in the first position and the release actuator is exposed when the seat is in the intermediate position.

14. An infant highchair comprising:

a standing frame;

a seat pivotally connected with the standing frame and having a seating surface and at least one hook, the seat being rotatable relative to the standing frame between a first position and a second position, the first position allowing a child to sit in contact with the seating surface, and the second position being suitable to receive installation of a removable child seat over the seat while disabling seating of a child on the seating surface; and a safety mechanism coupled to the standing frame, the safety mechanism being operable to restrict rotation of the seat from the first position to the second position and to allow continuous rotation of the seat from the second position to the first position, wherein the safety mechanism is movable between a hindering position and a release position, and in the hindering position, the safety mechanism is engageable with the at least one hook to restrict rotation of the seat from the first position to the second position;

wherein the safety mechanism is engageable with the at least one hook when the seat is in an intermediate position, the intermediate position being between the first position and the second position.

* * * * *